US009903206B2

(12) United States Patent
Yu et al.

(10) Patent No.: US 9,903,206 B2
(45) Date of Patent: Feb. 27, 2018

(54) IMPELLER

(75) Inventors: Po-Hao Yu, Taoyuan Hsien (TW); Shir-Harn Yeh, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 1093 days.

(21) Appl. No.: 13/272,201

(22) Filed: Oct. 12, 2011

(65) Prior Publication Data

US 2012/0093655 A1 Apr. 19, 2012

(30) Foreign Application Priority Data

Oct. 15, 2010 (CN) ..... 099135169

(51) Int. Cl.
*F04D 29/38* (2006.01)
*F01D 5/14* (2006.01)

(52) U.S. Cl.
CPC ..... *F01D 5/141* (2013.01); *F04D 29/384* (2013.01); *F04D 29/388* (2013.01); *F05D 2250/70* (2013.01)

(58) Field of Classification Search
CPC ..... F04D 29/38; F04D 29/384; F04D 29/386; F05F 2250/37; F05F 2250/38
USPC ..... 416/238, 242, 237, 235, 243
See application file for complete search history.

(56) References Cited

U.S. PATENT DOCUMENTS

| | | | | |
|---|---|---|---|---|
| 4,569,631 | A * | 2/1986 | Gray, III | 416/189 |
| 4,684,324 | A * | 8/1987 | Perosino | 416/189 |
| 5,000,660 | A * | 3/1991 | Van Houten et al. | 416/203 |
| 5,273,400 | A * | 12/1993 | Amr | 416/189 |
| 5,961,289 | A * | 10/1999 | Lohmann | 416/189 |
| 6,394,754 | B1 * | 5/2002 | Choi | 416/238 |
| 6,595,744 | B2 * | 7/2003 | Van Houten | 415/173.1 |
| 7,585,155 | B2 * | 9/2009 | Park et al. | 416/189 |
| 2007/0258812 | A1 | 11/2007 | Lee et al. | |
| 2007/0258822 | A1 | 11/2007 | Spaggiari | |
| 2008/0145230 | A1 * | 6/2008 | Harman et al. | 416/235 |

* cited by examiner

*Primary Examiner* — Richard Edgar
*Assistant Examiner* — Michael Sehn
(74) *Attorney, Agent, or Firm* — Kirton McConkie; Evan R. Witt

(57) ABSTRACT

An impeller includes a hub and a plurality of blades. The blades are disposed around an outer periphery of the hub. Each of the blades includes a connecting end, a sweep-back part and a sweep-forward part. The connecting end is coupled with the hub. The sweep-back part is disposed at an edge of the blade and extended from the connecting end. An extending direction of the sweep-back part is opposed to a rotating direction of the impeller. The sweep-forward part is extended from the sweep-back part. An extending direction of the sweep-forward part is the same as the rotating direction of the impeller.

10 Claims, 5 Drawing Sheets

IMPELLER

FIELD OF THE INVENTION

The present invention relates to an impeller, and more particularly to an impeller of a fan.

BACKGROUND OF THE INVENTION

With increasing development of science and technology, the functions and operating speeds of various electronic devices or mechanical systems are gradually enhanced. For maintaining normal operations, a forced convection mechanism (e.g. a fan) is installed in the electronic device or the mechanical system to dissipate heat that is generated by the electronic components of the electronic device or the mechanical system and maintain normal operating temperature. In view of power-saving efficacy, various electronic devices should have enhanced operating efficiency if the power consumption is fixed. For example, it is important to provide a fan having enhanced working efficiency in a power-saving manner.

FIG. 1 is a schematic top view illustrating an impeller of a fan according to the prior art. The impeller 1 comprises a hub 10 and a plurality of blades 11. The hub 10 is arranged at the center of the impeller 1. The blades 11 are disposed around the outer periphery of the hub 10. According to the practical requirements, the blades 11 have different profiles. For example, as shown in FIG. 1, the blades 11 are sweep-forward type blades.

As known, increasing the solidity of the blades 11 is a way of enhancing the working efficiency of the impeller 1. In the impeller 1, the ratio of the total area of the hub 10 and the blades 11 to the area of a circle whose radius R is from a center A to an outer periphery of the blades 11 is defined as the solidity. Moreover, for further increasing the working efficiency of the impeller 1, the blades 11 should be uniformly distributed. Since the length of the connecting end 111 and the stagger angle of each blade 11 are restricted by the perimeter of the hub 10, the number of blades 11 fails to be largely increased. Under this circumstance, the working efficiency of the impeller 1 is usually unsatisfactory.

Please refer to FIG. 1 again. There is a spacing interval B between every two adjacent blades 11. The spacing interval B between every two adjacent blades 11 at the outer peripheries of the blades 11 is wider than the spacing interval B between every two adjacent blades 11 near the hub 10. Under this circumstance, the number of blades 11 fails to be further increased, and thus it is difficult to effectively increase the solidity. Moreover, if large blades 11 are used to increase the solidity, every two adjacent blades 11 possibly overlap with each other. In this situation, the complexity of designing the mold of the impeller 1 and the fabricating cost of the impeller increases, and the performance of the fan deteriorates.

SUMMARY OF THE INVENTION

The present invention provides an impeller having increased solidity of blades and an increased number of blades, thereby enhancing the operating efficiency thereof.

In accordance with an aspect of the present invention, there is provided an impeller. The impeller includes a hub and a plurality of blades. The blades are disposed around an outer periphery of the hub. Each of the blades includes a connecting end, a sweep-back part and a sweep-forward part. The connecting end is coupled with the hub. The sweep-back part is disposed at an edge of the blade and extended from the connecting end. An extending direction of the sweep-back part is opposed to a rotating direction of the impeller. The sweep-forward part is extended from the sweep-back part. An extending direction of the sweep-forward part is the same as the rotating direction of the impeller.

In an embodiment, the impeller is installed in an axial-flow fan.

In an embodiment, the sweep-back part and the sweep-forward part are arranged at a front edge of the blade.

In an embodiment, the front edge of the blade is a windward edge, and a rear edge of the blade is opposed to the front edge.

In an embodiment, the blade further includes another sweep-back part and another sweep-forward part, which are arranged at the rear edge of the blade.

In an embodiment, the sweep-forward part of a specified blade and the rear edge of a previous blade are substantially parallel with each other.

In an embodiment, the impeller is rotated with respect to a rotating axis, the blade has a centerline, a stagger angle is defined between the centerline and a plane perpendicular to the rotating axis, and the stagger angle ranges between 10 and 60 degrees.

In an embodiment, the hub has a center. A base point is located between the hub and the sweep-back part, a sweep-back terminal point is located between the sweep-back part and the sweep-forward part, and a sweep-forward terminal point is located at the end of the sweep-forward part.

In an embodiment, a sweep-back angle is formed between a first line defined by the center and the base point and a second line defined by the center and the sweep-back terminal point. In addition, a sweep-forward angle is formed between the second line and a third line defined by the center and the sweep-forward terminal point.

In an embodiment, the sweep-back angle ranges between −10 and −60 degrees with respect to the first line.

In an embodiment, the sweep-forward angle ranges between 10 and 60 degrees with respect to the second line.

In an embodiment, a first radius R1 is defined from the center to the base point, a second radius R2 is defined from the center to the sweep-back terminal point, a third radius R3 is defined from the center to the outermost periphery of the blade, and a relationship between the R1, R2, and R3 is: $0.1<(R2-R1)/(R3-R1)<0.35$.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2A:
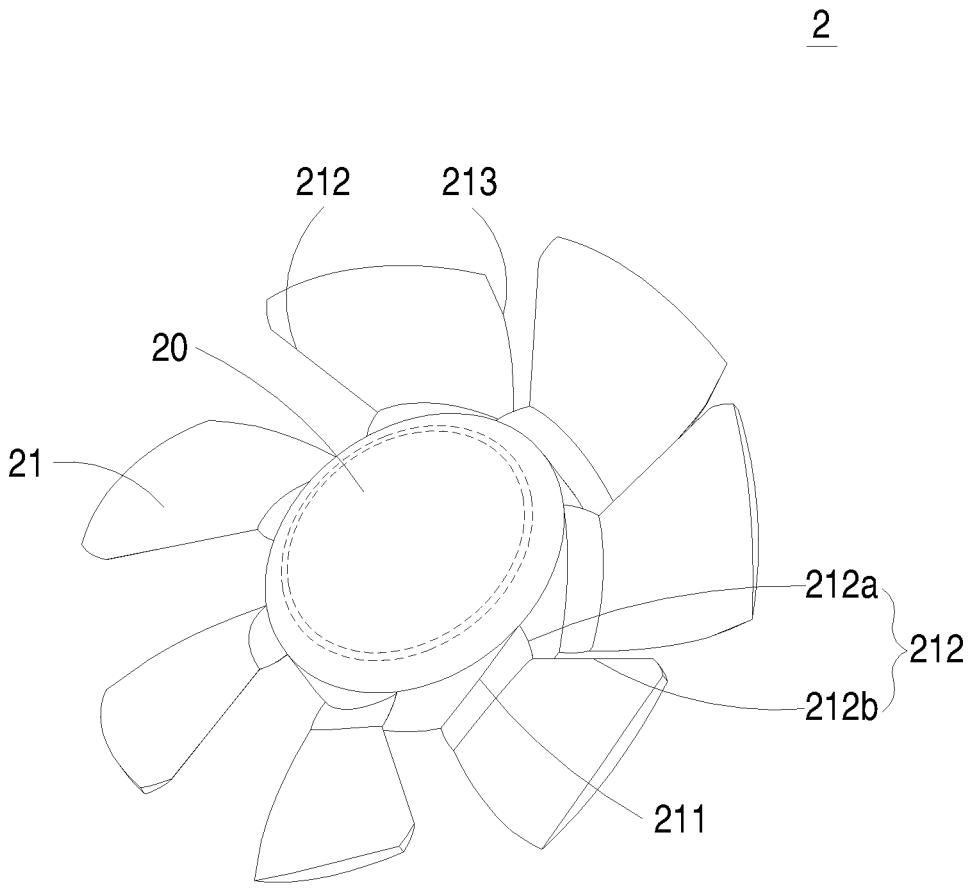
FIG. 2A is a schematic perspective view illustrating an impeller of an axial-flow fan according to an embodiment of the present invention.

FIG. 2A is a schematic perspective view illustrating an impeller of an axial-flow fan according to an embodiment of the present invention. The impeller 2 comprises a hub 20 and a plurality of blades 21. The hub 20 is arranged at the center of the impeller 2. The blades 21 are disposed around the outer periphery of the hub 20. Each of the blades 21 has a connecting end 211 connected to the outer periphery of the hub 20. In this embodiment, the impeller 2 is rotated in the counter-clockwise direction. The blade 21 has two sides. Upon rotation of the impeller 2, the front edge 212 of the blade 21 is a windward edge, and the other edge of the blade 21 is a rear edge 213. That is, the front edge 212 and the rear edge 213 are arranged at opposite sides of the blade 21. The front edge 212 comprises a sweep-back part 212*a* and a sweep-forward part 212*b*. The sweep-back part 212*a* is extended from the connecting end 211 in an extending direction opposed to the rotation direction of the impeller 2. The sweep-forward part 212*b* is extended from the sweep-back part 212*a* in an extending direction the same as the rotation direction of the impeller 2. In this embodiment, the sweep-back part 212*a* and the sweep-forward part 212*b* are formed on a single side (e.g. the front edge) of the blade 21. Alternatively, in some embodiments, another sweep-back part and another sweep-forward part may be also formed on the other side (e.g. the rear edge) of the blade 21. Meanwhile, both sides of the blade 21 have respective sweep-back parts and respective sweep-forward parts.

Figure 2B:
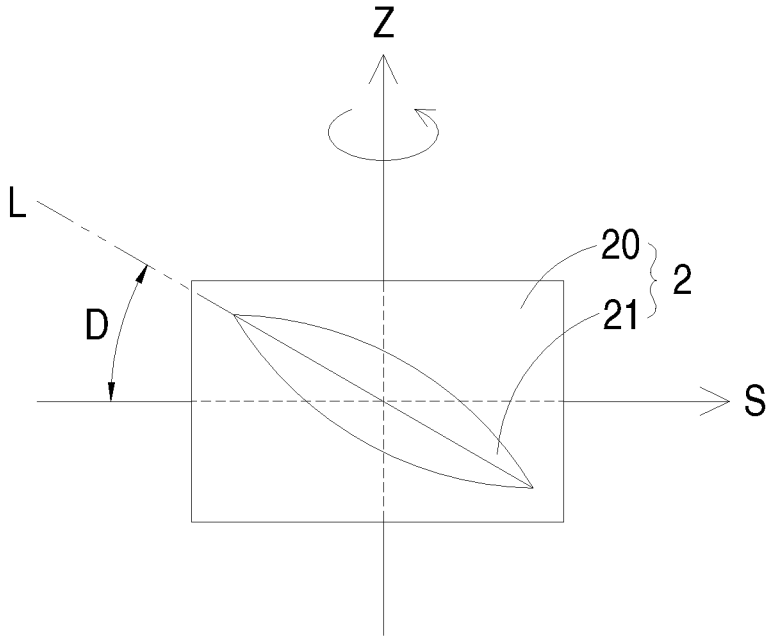
FIG. 2B is a schematic cross-sectional view illustrating a blade of the impeller of FIG. 2A.

FIG. 2B is a schematic cross-sectional view illustrating a blade of the impeller of FIG. 2A. The Z axis (i.e. rotating axis) indicates the direction of the center bearing of the impeller 2. That is, the impeller 2 is rotated with respect to the Z axis. The cross section of the blade 21 has a centerline L. A stagger angle D is defined between the centerline L and a plane S perpendicular to the rotating axis. As the stagger angle D is changed, the surface pressure distribution of the impeller 2 is changed, thereby adjusting the airflow amount passing through the impeller 2. If the stagger angle D is too large, a problem of causing re-circulation of the airflow will possibly occur. Under this circumstance, the working efficiency of the impeller 2 is impaired. For maintaining good working efficiency, the stagger angle D ranges between 10 and 60 degrees.

Figure 2C:
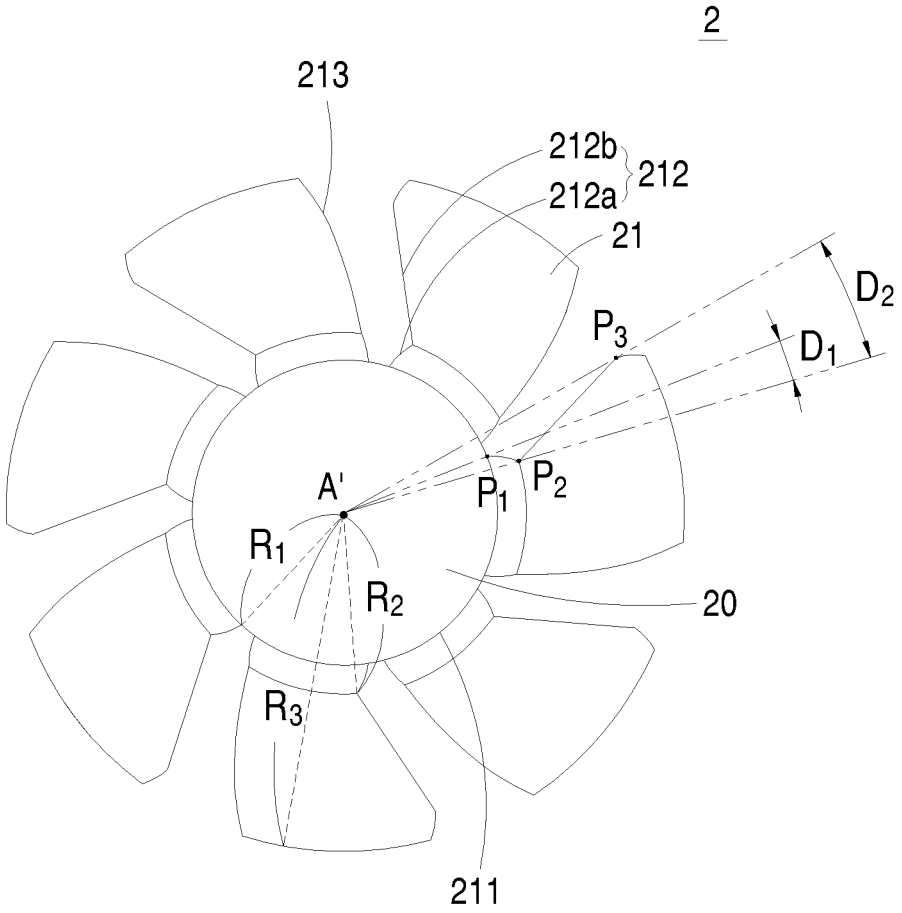
FIG. 2C is a schematic top view illustrating the impeller of FIG. 2A.

FIG. 2C is a schematic top view illustrating the impeller of FIG. 2A. The hub 20 of the impeller 2 has a center A'. From the connecting end 211 to the sweep-forward part 212*b* through the sweep-back part 212*a*, the blade 21 comprises a base point P1, a sweep-back terminal point P2 and a sweep-forward terminal point P3. The base point P1 is located between the hub 20 and the sweep-back part 212*a*, the sweep-back terminal point P2 is located between the sweep-back part 212*a* and the sweep-forward part 212*b*, and the sweep-forward terminal point P3 is located at the end of the sweep-forward part 212*b*. Namely, the sweep-back part 212*a* is formed between the base point P1 and the sweep-back terminal point P2, and the sweep-forward part 212*b* is formed between the sweep-back terminal point P2 and the sweep-forward terminal point P3. A sweep-back angle D1 is formed between a first line defined by the center A' and the base point P1 and a second line defined by the center A' and the sweep-back terminal point P2. In addition, a sweep-forward angle D2 is formed between the second line and a third line defined by the center A' and the sweep-forward terminal point P3. In addition, a first radius R1 is defined from the center A' to the base point P1, a second radius R2 is defined from the center A' to the sweep-back terminal point P2, and a third radius R3 is defined from the center A' to the outermost periphery of the blade 21. A relationship between the first radius R1, the second radius R2 and the third radius R3 is: $0.1<(R2-R1)/(R3-R1)<0.35$.

In a case that the stagger angle D ranges between 10 and 60 degrees, the sweep-back angle D1 ranges between −10 and −60 degrees with respect to the first line, and the sweep-forward angle D2 ranges between 10 and 60 degrees with respect to the second line. Since the impeller 2 is designed according to the relationship between the first radius R1, the second radius R2 and the third radius R3, the power consumption is reduced by about 10% if the airflow amount and the airflow pressure are fixed.

Please refer to FIG. 2C again. In the impeller 2 of the present invention, the sweep-back part 212*a* and the sweep-forward part 212*b* are arranged at the same edge of the blade 21, and the sweep-forward part 212*b* is arranged behind the sweep-back part 212*a*. Consequently, the rear edge 213 of a specified blade 21 and the front edge 212 of a next blade 21 are substantially identical parallel with each other. That is, the sweep-forward part 212*b* of a specified blade 21 and the rear edge 213 of a previous blade 21 are substantially parallel with each other. Since the number of blade 21 or the area of the blade 21 can be increased, the solidity is increased. Under this circumstance, the operating efficiency of the impeller 2 is enhanced.

Figure 1:
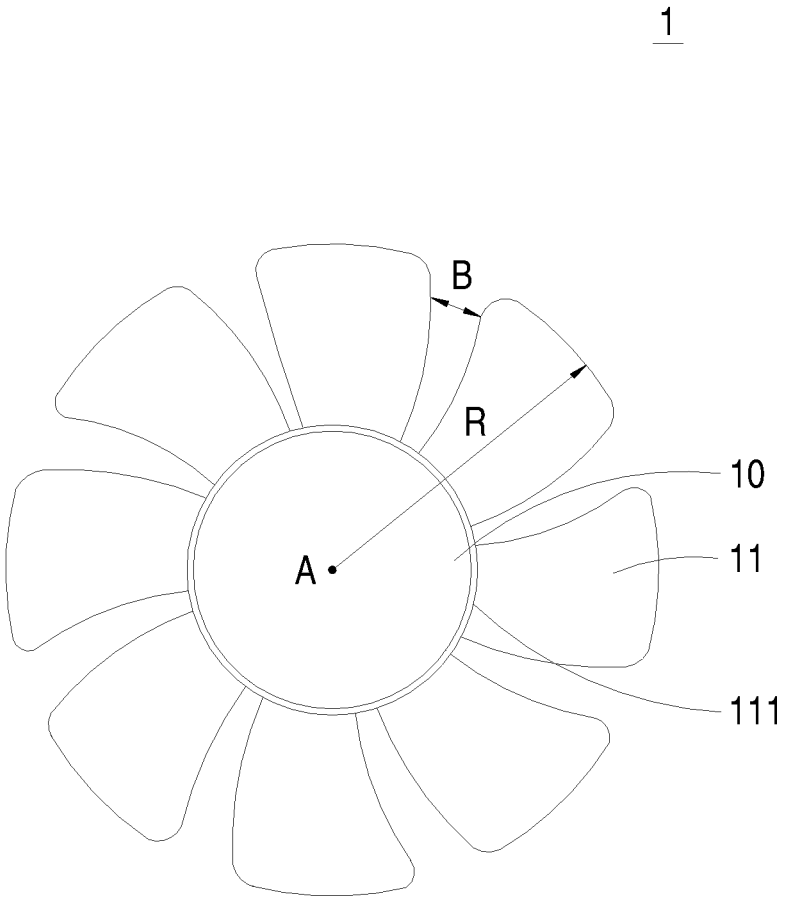
FIG. 1 PRIOR ART
FIG. 1 is a schematic top view illustrating an impeller of a fan according to the prior art.
Figure 3:
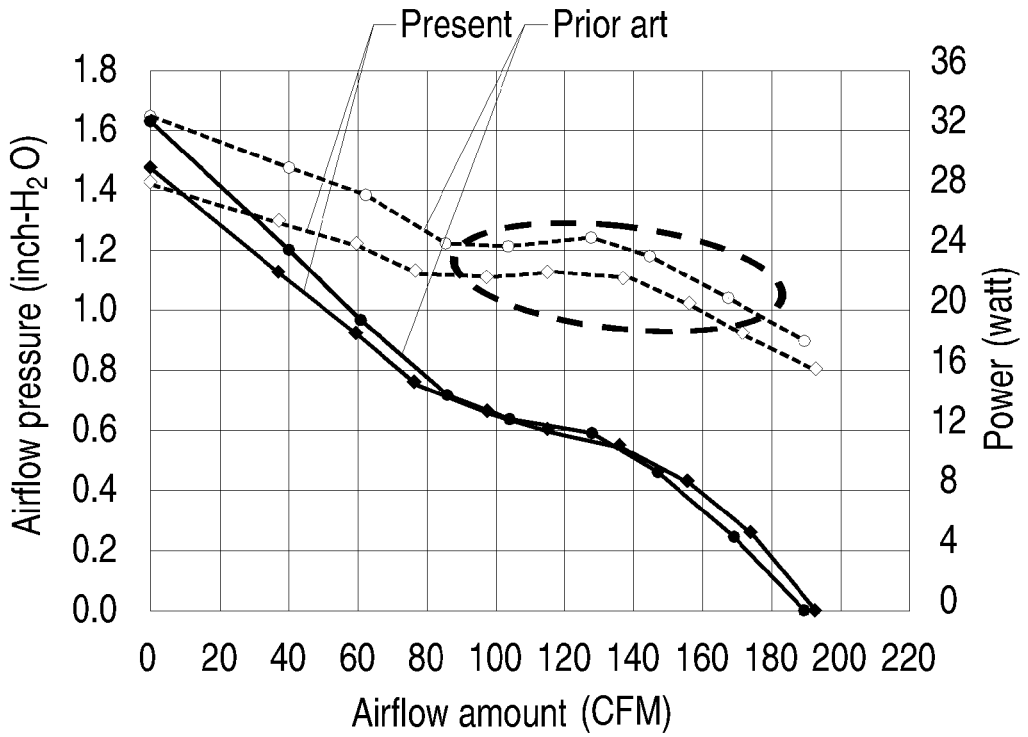
FIG. 3 is a schematic plot illustrating the relationship between the airflow amount, the airflow pressure and the power consumption of the impeller of FIG. 2A in comparison with the impeller of FIG. 1.

FIG. 3 is a schematic plot illustrating the relationship between the airflow amount, the airflow pressure and the power consumption of the impeller of FIG. 2A in comparison with the impeller of FIG. 1. The solid curves indicate the relationships between the airflow amount and the airflow pressure of the impeller 2 of the present invention and the conventional impeller 1. The dashed curves indicate the relationships between the airflow pressure and the power consumption of the impeller 2 of the present invention and the conventional impeller 1. Assuming that the airflow amount is 140 CFM (ft3/min), the power consumption of the impeller 2 is obviously lower than the power consumption of the conventional impeller 1. That is, since the power consumption of the impeller 2 of the present invention is reduced, the power-saving purpose is achieved.

From the above description, the impeller of the present invention comprises a plurality of blades. Each of the blades comprises a connecting end, a sweep-back part and a sweep-forward part. The sweep-back part is extended from the connecting end. The sweep-forward part is extended from the sweep-back part. The sweep-back part and the sweep-forward part define a front edge of the blade. Since the sweep-forward part is arranged behind the sweep-back part, the number of blades can be increased but every two adjacent blades are not overlapped with each other. In this situation, the solidity of the plurality of blades will be increased, and thus the operating efficiency of the impeller is enhanced. That is, in the condition that the airflow amount and the airflow pressure are identical, the power consumption of the impeller of the present invention is largely reduced when compared with the conventional impeller.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An impeller, comprising:

a hub; and a plurality of blades disposed around an outer periphery of said hub, wherein each of said blades comprises:

a connecting end coupled with said hub;

a sweep-back part disposed at an edge of said blade and extended from the connecting end, wherein an extending direction of said sweep-back part is opposed to a rotating direction of said impeller; and a sweep-forward part extended from said sweep-back part, wherein an extending direction of said sweep-forward part is the same as said rotating direction of said impeller, wherein an angular part is formed between said sweep-back part and said sweep-forward part, said hub has a center, a base point is located between said hub and said sweep-back part, a sweep-back terminal point is located between said sweep-back part and said sweep-forward part for forming said angular part, a sweep-forward terminal point is located at the end of said sweep-forward part, a sweep-back angle is formed between a first line defined by said center and said base point and a second line defined by said center and said sweep-back terminal point, and a sweep-forward angle is formed between said second line and a third line defined by said center and said sweep-forward terminal point, and said sweep-back angle ranges between −10 and −60 degrees with respect to said first line.

2. The impeller according to claim 1, wherein said impeller is installed in an axial-flow fan.

3. The impeller according to claim 1, wherein said sweep-back part and said sweep-forward part are arranged at a front edge of said blade.

4. The impeller according to claim 3, wherein said front edge of said blade is a windward edge, and a rear edge of said blade is opposed to said front edge.

5. The impeller according to claim 4, wherein said blade further includes another sweep-back part and another sweep-forward part, which are arranged at said rear edge of said blade.

6. The impeller according to claim 4, wherein said sweep-forward part of a specified blade and said rear edge of a previous blade are substantially parallel with each other.

7. The impeller according to claim 1, wherein said impeller is rotated with respect to a rotating axis, said blade has a centerline, a stagger angle is defined between said centerline and a plane perpendicular to said rotating axis, and said stagger angle ranges between 10 and 60 degrees.

8. The impeller according to claim 1, wherein a first radius R1 is defined from said center to said base point, a second radius R2 is defined from said center to said sweep-back terminal point, a third radius R3 is defined from said center to the outermost periphery of said blade, and a relationship between said R1, R2, and R3 is: $0.1<(R2-R1)/(R3-R1)<0.25$.

9. An impeller, comprising:

a hub; and a plurality of blades disposed around an outer periphery of said hub, wherein each of said blades comprises:

a connecting end coupled with said hub;

a sweep-back part disposed at an edge of said blade and extended from the connecting end, wherein an extending direction of said sweep-back part is opposed to a rotating direction of said impeller; and a sweep-forward part extended from said sweep-back part, wherein an extending direction of said sweep-forward part is the same as said rotating direction of said impeller, wherein an angular part is formed between said sweep-back part and said sweep-forward part, said hub has a center, a base point is located between said hub and said sweep-back part, a sweep-back terminal point is located between said sweep-back part and said sweep-forward part for forming said angular part, a sweep-forward terminal point is located at the end of said sweep-forward part, a sweep-back angle is formed between a first line defined by said center and said base point and a second line defined by said center and said sweep-back terminal point, and a sweep-forward angle is formed between said second line and a third line defined by said center and said sweep-forward terminal point, and said sweep-forward angle ranges between 10 and 60 degrees with respect to said second line.

10. An impeller, comprising:

a hub; and a plurality of blades disposed around an outer periphery of said hub, wherein each of said blades comprises:

a connecting end coupled with said hub;

a sweep-back part disposed at an edge of said blade and extended from the connecting end, wherein an extending direction of said sweep-back part is opposed to a rotating direction of said impeller; and a sweep-forward part extended from said sweep-back part, wherein an extending direction of said sweep-forward part is the same as said rotating direction of said impeller, wherein an angular part is formed between said sweep-back part and said sweep-forward part, said hub has a center, a base point is located between said hub and said sweep-back part, a sweep-back terminal point is located between said sweep-back part and said sweep-forward part for forming said angular part, a sweep-forward terminal point is located at the end of said sweep-forward part, a sweep-back angle is formed between a first line defined by said center and said base point and a second line defined by said center and said sweep-back terminal point, and a sweep-forward angle is formed between said second line and a third line defined by said center and said sweep-forward terminal point, said sweep-back angle ranges between −10 and −60 degrees with respect to said first line, and said sweep-forward angle ranges between 10 and 60 degrees with respect to said second line.

* * * * *